US007231170B2

(12) United States Patent
Lundy et al.

(10) Patent No.: US 7,231,170 B2
(45) Date of Patent: Jun. 12, 2007

(54) DUAL-PURPOSE SURFACE-TREATING BLADE ASSEMBLY

(75) Inventors: Douglas A. Lundy, Webster, NY (US); Anthony L. Paolini, Rochester, NY (US); D Clay Johnson, Rochester, NY (US); Robert B. Anderson, Jr., Syracuse, NY (US); Michael Q. Lu, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 259 days.

(21) Appl. No.: 11/068,027

(22) Filed: Feb. 28, 2005

(65) Prior Publication Data

US 2006/0193663 A1 Aug. 31, 2006

(51) Int. Cl.
*G03G 21/00* (2006.01)

(52) U.S. Cl. ..... 399/350; 399/351

(58) Field of Classification Search ..... 399/107, 399/123, 343, 350, 351; 15/256.5, 256.51, 15/256.52

See application file for complete search history.

(56) References Cited

U.S. PATENT DOCUMENTS 5,214,479 A 5/1993 Lindblad et al.
5,517,294 A * 5/1996 Ogiri et al. ..... 399/351
5,702,812 A * 12/1997 Bracken et al. ..... 428/323
5,724,640 A 3/1998 Thayer
5,732,320 A 3/1998 Domagall et al.
6,134,405 A * 10/2000 Zona ..... 399/148
6,282,401 B1 8/2001 Proulx et al.

* cited by examiner

*Primary Examiner*—Hoan Tran
(74) *Attorney, Agent, or Firm*—Tallam I. Nguti

(57) ABSTRACT

A surface-treating apparatus has a dual-purpose surface-treating blade assembly that includes a blade holder for holding and loading a blade member, and a one-piece blade member having a first edge mounted to the blade holder and a second edge for contacting and treating a surface. The one-piece blade member has a mid-portion for applying a first edge-loading force to lightly contact and remove random spots from a central imaging region of the surface, a first end portion, and a second end portion. The dual-purpose blade assembly also includes a first shim device and a second shim device assembled respectively to the first end portion and to the second end portion of the blade member for stiffening such end portions and increasing a magnitude of each of a second and a third different edge-loading forces at such end portions relative to the first edge-loading force.

20 Claims, 4 Drawing Sheets

DUAL-PURPOSE SURFACE-TREATING BLADE ASSEMBLY

BACKGROUND

The present disclosure relates generally to electrostatographic reproduction machines, and more particularly, concerns a dual purpose surface-treating blade assembly for removing random spots from, as well as cleaning edge areas of, a moving image bearing surface within such a machine.

In a typical toner image reproduction machine, for example an electrostatographic printing process machine, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. Residual toner particles remaining on the photoconductive surface following image transfer as above are then removed by a cleaning apparatus and the surface treated in order to prepare the surface for forming another toner image.

The foregoing generally describes a typical black and white electrostatographic printing machine. With the advent of multicolor electrophotography, it is desirable to use an image-on-image architecture that comprises a plurality of image forming stations. One example of the plural image forming station architecture utilizes an image-on-image (IOI) system in that the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color. Again as above, residual toner particles remaining on the photoconductive surface following image transfer as above are then removed by a cleaning apparatus and the surface treated in order to prepare the surface for forming another toner image.

It has been found that image-on-image processes, for example, create very high toner densities on the photoconductive or photoreceptor surface. In some machines using toner particles with toner additives in similar multi-color processes, the additional use of control patches, and engagements in component-disturbing activities such as recovery from paper jams, together create conditions that make cleaning or removal of residual toner particles from the imaging region as well as elsewhere very challenging for ordinary conventional cleaning apparatus. The situation is made worse when such conditions are combined with higher process speeds, and demands for higher print quality, longer component lives and higher machine reliability.

The following references disclose examples of existing surface cleaning and treating devices. U.S. Pat. No. 5,214,479 issued May 25, 1993 and entitled "BTR air cleaner with biased shims" discloses apparatus for cleaning residual toner and paper fiber residue from a biased transfer roll (BTR) in an electrophotographic apparatus using high velocity air and substantially contactless flexible biased conductive shims. The high velocity air flow between the BTR and two thin conductive flex-shims is created by means of a blower that evacuates the air in the cleaner housing vacuum chamber. The high velocity air, in combination with the electrically biased BTR and flex-shims, removes residue from the BTR surface and carries it into the vacuum chamber and deposits the residue in a filter bag. The BTR biased shim cleaner system is low cost, efficient and significantly smaller than current BTR cleaning devices.

U.S. Pat. No. 5,732,320 issued Mar. 24, 1998 and entitled "Cleaning blade" discloses a spots cleaning blade for use in a cleaning apparatus in an imaging apparatus for cleaning agglomerate particles from an imaging surface, the spots cleaning blade comprising a polyether urethane and having a high hardness and low coefficient of friction.

U.S. Pat. No. 5,724,640 issued Mar. 3, 1998 and entitled "Floating backer and mount for cleaning blades and spots blades on belt imaging surfaces" discloses apparatus for cleaning particles from a surface using a floating backer and cleaning or spots blade mounted to allow freedom to follow the location of the imaging surface. The cleaning or spots blade controls tolerances when the blade and the floating backer are mounted to a frame pivoted from a fixed photoreceptor backer. This freedom allows a minimization of the tolerances in blade load against the surface or photoreceptor, the blade angle to the photoreceptor and in the location of the blade relative to the backer. This floating backer and blade mount also minimizes the wrap required on the photoreceptor backers adjacent to the blade.

U.S. Pat. No. 6,282,401 issued Aug. 28, 2001 and entitled "Hard cleaning blade for cleaning an imaging member" discloses a relatively hard cleaning blade for use in a cleaning apparatus in an imaging apparatus for cleaning residual toner particles, including dry and liquid ink toners and carriers, from an imaging surface, the cleaning blade having a material having a hardness of from about 86 to about 120 Shore A.

As disclosed in the above examples, the uses of existing cleaning devices such as cleaning brushes and cleaning blades along with other existing surface treating devices such as spots blades, are well known. For a number of reasons including surface cleaning or treatment requirements that are often dictated by the nature of the adhesive forces holding residual toner particles to the photoreceptor surface, such existing cleaning devices and existing surface treatment devices in the above examples are typically adapted for cleaning and treating the imaging region of the photoreceptor image bearing surfaces. Accordingly, they are unsuitable and not adapted for effectively cleaning and treating the edge or margin regions that flank the imaging region of the photoreceptor image bearing surface.

It has been found that desired image quality can be detrimentally affected by a build up of airborne or spilled over toner particles and dirt on the edge or margin regions of the photoreceptor, that is, the regions that are outside of, and flank the imaging region of the photoreceptor surface. The build up occurs because the existing cleaning devices (such as a brush cleaner) and treatment devices (such as a conventional spots blade) are adapted to, and function to clean and treat only the imaging region.

Therefore, in electrostatographic toner image reproduction machines, there is still a need for a toner image bearing surface cleaning and treating apparatus that is adapted to both clean and treat the imaging regions as well as the edge or margin regions of the toner image bearing or photoreceptor surface.

SUMMARY

In accordance with one aspect of the present disclosure, there is provided a surface-treating apparatus having a dual-purpose surface-treating blade assembly that includes a blade holder for holding and loading a blade member, and a one-piece blade member having a first edge mounted to the blade holder and a second edge for contacting and treating a surface. The one-piece blade member has a mid-portion for applying a first edge-loading force to lightly contact and remove random spots from a central imaging region of the surface, a first end portion, and a second end portion. The dual-purpose blade assembly also includes a first shim device and a second shim device assembled respectively to the first end portion and to the second end portion of the blade member for stiffening such end portions and increasing a magnitude of each of a second and a third different edge-loading forces at such end portions relative to the first edge-loading force.

BRIEF DESCRIPTION OF THE DRAWINGS

The foregoing and other features of the instant disclosure will be apparent and easily understood from a further reading of the specification, claims and by reference to the accompanying drawings in that:

DETAILED DESCRIPTION OF THE DISCLOSURE

While the present disclosure will be described hereinafter in connection with a preferred embodiment thereof, it should be understood that it is not intended to limit the disclosure to that embodiment. On the contrary, it is intended to cover all alternatives, modifications and equivalents as may be included within the spirit and scope of the disclosure as defined in the appended claims.

Figure 1:
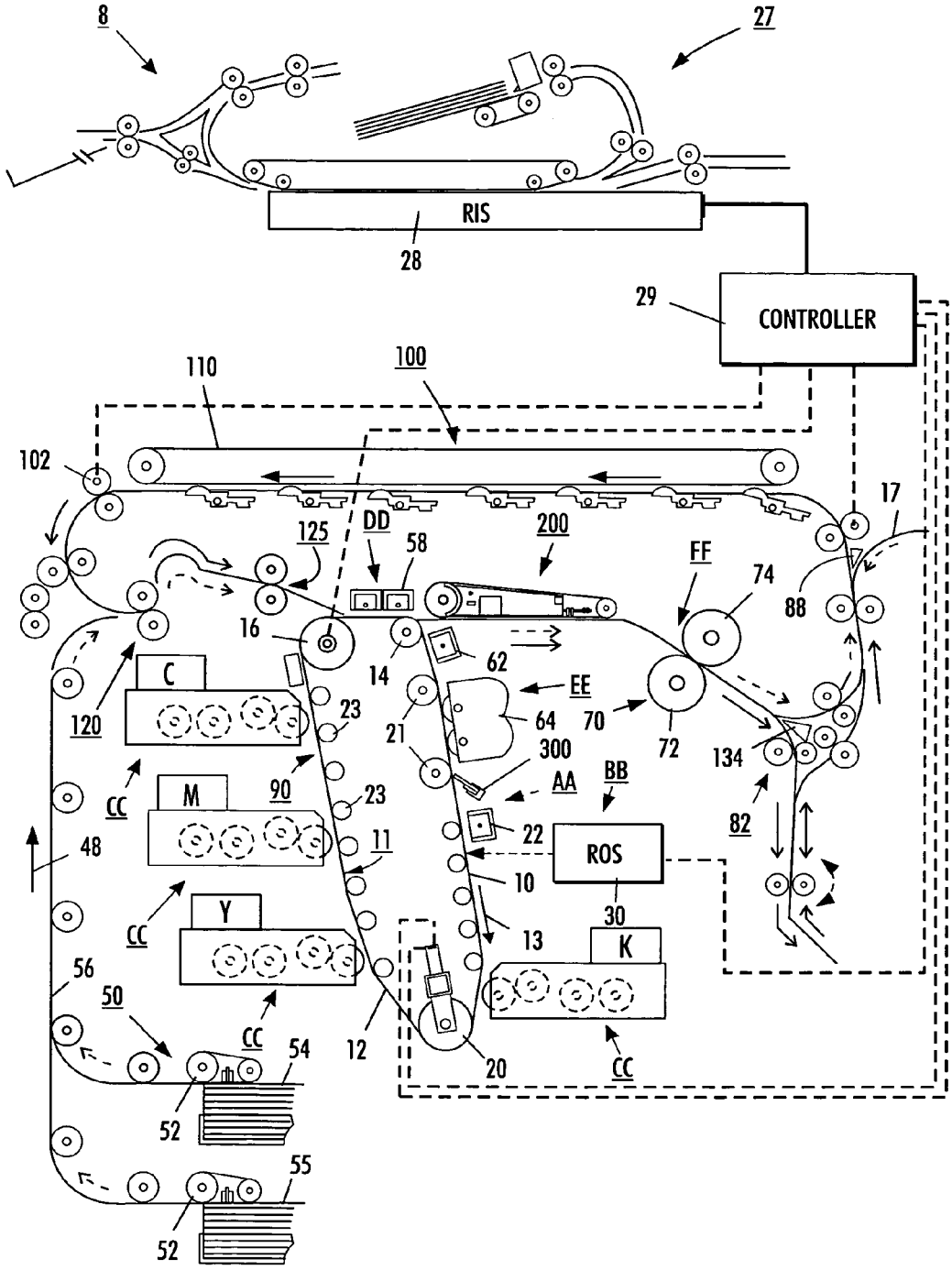
FIG. 1 is a schematic elevational view of an exemplary electrostatographic reproduction machine depicting the toner image bearing surface cleaning and treating apparatus including the dual-purpose surface-treating blade assembly of the present disclosure.
Figure 2:
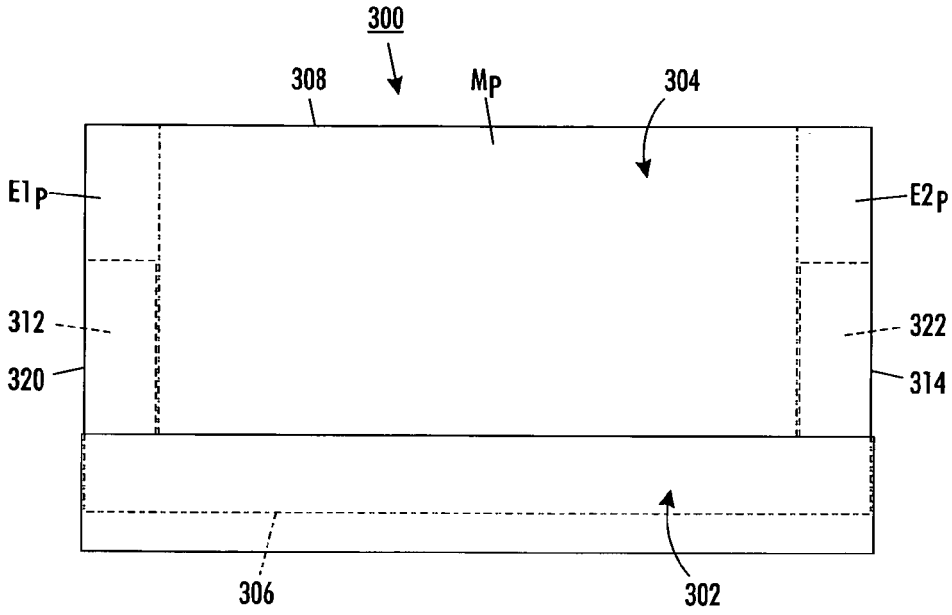
FIGS. 2-3 are each a plan view of a section of the machine of FIG. 1 showing the dual-purpose surface treating blade assembly and loading forces of the present disclosure.
Figure 3:
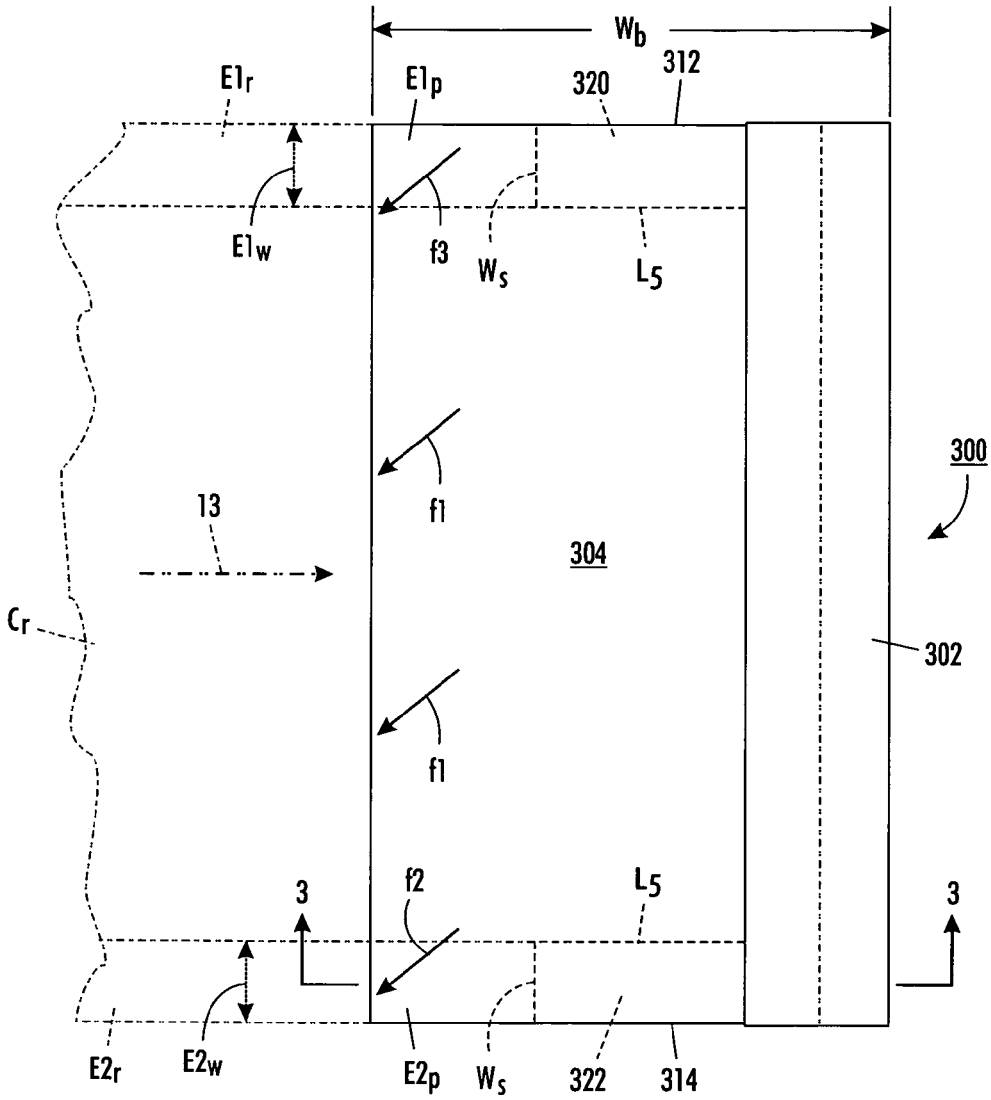
Figure 4:
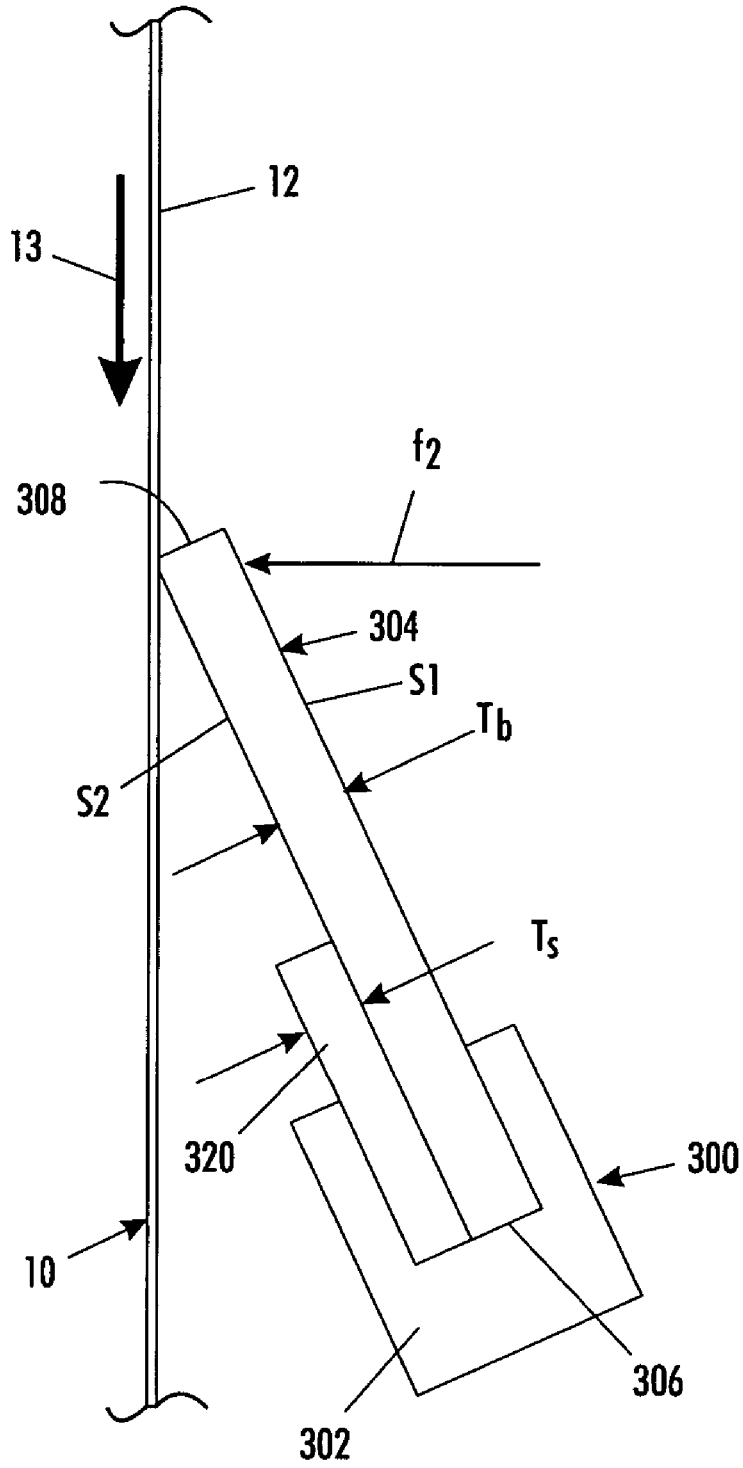
FIG. 4 a section along plane 4-4 through an end portion of the dual-purpose surface-treating blade assembly in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly 200 and forwarded to fusing station FF.

Fusing station FF includes a fuser assembly indicated generally by the reference numeral 70 that permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent is transferred to a donor roll (not shown) and then to the fuser roll 72.

The sheet then passes through fuser 70 where the image is permanently fixed or fused to the sheet. After passing through fuser 70, a gate 88 either allows the sheet to move directly via output 17 to a finisher or stacker, or deflects the sheet into the duplex path 100. Specifically, the sheet when to be directed into the duplex path 100, is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before exiting path 17.

After the print sheet is separated from photoconductive surface 12 of belt 10, the residual toner/developer and paper fiber particles still on and may be adhering to photoconductive surface 12 are then removed therefrom at cleaning and surface-treating station EE in accordance with the present disclosure.

Referring now to FIGS. 1-4, the cleaning and surface-treating station EE as illustrated includes a pre-cleaning charging device 62 for charging toner particles on photoconductive or moving toner image bearing surface 12 to a first polarity, and a cleaning device such as a brush apparatus 64 positioned centrally relative to an edge-to-edge dimension of the moving toner image bearing surface 12 for cleaning a corresponding central imaging region Cr of the moving toner image bearing surface 12 by removing charged residual toner particles therefrom.

The cleaning and surface-treating station EE as illustrated also includes dual-purpose surface-treating blade assembly 300 of the present disclosure for both treating the centrally located imaging region Cr and fully cleaning edge regions E1*r*, E2*r*, that flank the imaging region Cr. As shown, the dual-purpose surface-treating blade assembly 300 includes (i) an elongate blade holder 302 for holding and loading a surface-treating blade member against the moving toner image bearing surface 12, and (ii) a one-piece elongate blade member 304 having a first elongate edge 306 connecting a first end 312 and a second end 314 for mounting to the elongate blade holder 302. The one-piece elongate blade member 304 also has a second elongate edge 308 opposite the first elongate edge 306 for contacting and treating the surface 12, and first and second sides S1, S2 each connecting the first elongate edge 306 to the second elongate edge 308. The one-piece elongate blade member 304 further comprises a mid-portion Mp for applying a first edge-loading force f1 to lightly contact and remove random spots from the corresponding central imaging region Cr of the moving toner image bearing surface 12, a first end portion E1*p*, and a second end portion E2*p*, located towards the first end 312 and the second end 314 respectively, for applying a second different edge-loading force f2 and a third different edge-loading force f3 respectively to strongly contact and fully clean corresponding edge regions E1*r*, E2*r* of the moving toner image bearing surface 12.

As further shown, the dual-purpose surface-treating blade assembly 300 also includes a first shim device 320 and a second shim device 322 assembled respectively to the first end portion E1*p* and the second end portion E2*p* of the one-piece elongate blade member 304 for stiffening such end portions E1*p*, E2*p* and increasing a magnitude of each of the second different edge-loading force f2 and the third different edge-loading force f3 relative to the first edge-loading force f1. As designed and assembled, the different third edge-loading force f3 will be approximately equal to the different second edge-loading force f2. For example, where f1 is approximately 10 gm/cm, f3 and f2 will be each about 22 gm/cm.

In one embodiment for example, the one-piece elongate blade member 304 is made of a urethane material and each of the first shim device 320 and the second shim device 322 is also made of a urethane material. In this embodiment, each of the first shim device 320 and the second shim device 322 for example has a thickness Ts that is approximately equal to a thickness Tb of the one-piece elongate blade member 304. In other embodiments, each of the first shim device 320 and the second shim device 322 can be made of plastic material such as polyethylene, or of stainless steel. In such other embodiments, each of the first shim device 320 and the second shim device 322 can have a thickness Ts that is less than the thickness Tb of the one-piece elongate blade member 304.

As further illustrated, each of the first shim device 320 and the second shim device 322 is mounted to the blade holder 302 and into contact with the elongate blade member 304. As shown, such contact is with that side, for example the second side S2 of the first and the second sides S1, S2 that is positioned downstream of the elongate second edge 308 relative to a direction of movement as shown by the arrow 13 of the moving surface 12. In addition, each of the first shim device 320 and the second shim device 322 as assembled has an in process direction dimension or length Ls that is less than a width Wb of the one-piece elongate blade member 304. Further, each of the first shim device 320 and the second shim device 322 as assembled has a cross-process direction dimension Ws that is equal to a cross-process dimension E1*w*, E2*w* of the corresponding edge region E1*r*, E2*r* of the photoreceptor surface 12.

As can been seen, there has been provided a surface-treating apparatus having a dual-purpose surface-treating blade assembly that includes a blade holder for holding and loading a blade member, and a one-piece blade member having a first edge mounted to the blade holder and a second edge for contacting and treating a surface. The one-piece blade member has a mid-portion for applying a first edge-loading force to lightly contact and remove random spots from a central imaging region of the surface, a first end portion, and a second end portion. The dual-purpose blade assembly also includes a first shim device and a second shim device assembled respectively to the first end portion and to the second end portion of the blade member for stiffening such end portions and increasing a magnitude of each of a second and a third different edge-loading forces at such end portions relative to the first edge-loading force.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A dual-purpose surface-treating blade assembly comprising:

(a) an elongate blade holder for holding and loading a surface-treating blade member against a moving surface being treated;

(b) a one-piece elongate blade member having (i) a first end, (ii) a second end, (iii) a first elongate edge connecting said first end and said second end for mounting to said elongate blade holder, (iv) a second elongate edge opposite said first elongate edge for contacting and treating said surface being treated, and (v) first and second sides each connecting said first elongate edge to said second elongate edge, said one-piece elongate blade member comprising a mid-portion for applying a first edge-loading force to lightly contact and remove random spots from a corresponding mid-portion of said moving surface being treated, a first end portion, and a second end portion, located towards said first end and said second end respectively, for applying a second different edge-loading force and a third different edge-loading force respectively for strongly contacting and fully cleaning corresponding edge portions of said moving surface being treated; and (c) a first shim device and a second shim device assembled respectively to said first end portion and said second end portion of said one-piece elongate blade member for increasing a magnitude of each of said second different edge-loading force and said third different edge-loading force relative to said first edge-loading force.

2. The dual-purpose surface-treating blade assembly of claim 1, wherein said one-piece elongate blade member is made of a urethane material.

3. The dual-purpose surface-treating blade assembly of claim 1, wherein each of said first shim device and said second shim device is made of a urethane material.

4. The dual-purpose surface-treating blade assembly of claim 3, wherein each of said first shim device and said second shim device has a thickness approximately equal to a thickness of said one-piece elongate blade member.

5. The dual-purpose surface-treating blade assembly of claim 1, wherein each of said first shim device and said second shim device is made of plastic material.

6. The dual-purpose surface-treating blade assembly of claim 5, wherein each of said first shim device and said second shim device has a thickness less than a thickness of said one-piece elongate blade member.

7. The dual-purpose surface-treating blade assembly of claim 1, wherein each of said first shim device and said second shim device is made of stainless steel.

8. The dual-purpose surface-treating blade assembly of claim 7, wherein each of said first shim device and said second shim device has a thickness less than a thickness of said one-piece elongate blade member.

9. The dual-purpose surface-treating blade assembly of claim 1, wherein each of said first shim device and said second shim device is mounted to said blade holder and into contact with said elongate blade member.

10. The dual-purpose surface-treating blade assembly of claim 1, wherein each of said first shim device and said second shim device is assembled into contact with a one of said first and said second sides that is positioned downstream of said elongate second edge relative to a direction of movement of said moving surface being treated.

11. The dual-purpose surface-treating blade assembly of claim 1, wherein each of said first shim device and said second shim device as assembled has an in process direction dimension Ls that is less than a width Wb of said one-piece elongate blade member.

12. The dual-purpose surface-treating blade assembly of claim 1, wherein said different third edge-loading force is approximately equal to said different second edge-loading force.

13. The dual-purpose surface-treating blade assembly of claim 1, wherein each of said first shim device and said second shim device as assembled has a cross-process direction dimension Ws that is equal to a cross-process dimension of a corresponding edge region of a photoreceptor surface.

14. A toner image bearing surface cleaning and treating apparatus comprising:

(a) a pre-cleaning charging device for charging toner particles on a moving toner image bearing surface to a first polarity;

(b) a cleaning device positioned centrally relative to an edge-to-edge dimension of said moving toner image bearing surface for cleaning a corresponding central imaging region of said moving toner image bearing surface by removing charged residual toner particles therefrom; and (c) a dual-purpose surface-treating blade assembly including:

(i) an elongate blade holder for holding and loading a surface-treating blade member against said moving toner image bearing surface being treated;

(ii) a one-piece elongate blade member having a first elongate edge connecting a first end and a second end for mounting to said elongate blade holder, a second elongate edge opposite said first elongate edge for contacting and treating said surface being treated, and first and second sides each connecting said first elongate edge to said second elongate edge, said one-piece elongate blade member comprising a mid-portion for applying a first edge-loading force to lightly contact and remove random spots from said corresponding central imaging region of said moving toner image bearing surface being treated, a first end portion, and a second end portion, located towards said first end and said second end respectively, for applying a second different edge-loading force and a third different edge-loading force respectively to strongly contact and fully clean corresponding edge regions of said moving toner image bearing surface being treated; and (iii) a first shim device and a second shim device assembled respectively to said first end portion and said second end portion of said one-piece elongate blade member for increasing a magnitude of each of said second different edge-loading force and said third different edge-loading force relative to said first edge-loading force.

15. The toner image bearing surface cleaning and treating apparatus of claim 14, wherein each of said first shim device and said second shim device is assembled into contact with a one of said first and said second sides that is positioned downstream of said elongate second edge relative to a direction of movement of said moving surface being treated.

16. The toner image bearing surface cleaning and treating apparatus of claim 14, wherein each of said first shim device and said second shim device as assembled has an in process direction dimension Ls that is less than a width Wb of said one-piece elongate blade member.

17. An electrostatographic reproduction machine comprising:

(a) a movable toner image bearing member having an image bearing surface including a centrally located imaging region and first and second edge regions flanking said imaging region;

(b) toner image forming devices mounted a path of movement of said toner image bearing surface for forming on a toner image on said movable toner image bearing surface;

(c) transfer means for transferring said toner image from said movable toner image bearing surface onto a substrate;

(d) a cleaning device positioned centrally relative to an edge-to-edge dimension of said moving toner image bearing surface for cleaning said central imaging region by removing residual toner particles therefrom; and (e) a dual-purpose surface-treating blade assembly including:

(i) a blade holder for holding and loading a blade member;

(ii) a one-piece blade member having a first edge mounted to said blade holder and a second edge for contacting and treating said moving toner image bearing surface, said one-piece blade member having a mid-portion for applying a first edge-loading force to lightly contact and remove random spots from a central imaging region of said moving toner image bearing surface, a first end portion, and a second end portion; and (iii) a first shim device and a second shim device assembled respectively to said first end portion and to said second end portion of said one-piece blade member for stiffening said first end portion and said second end portion to increase a magnitude of each of a second and a different edge-loading forces at said first end portion and said second end portion relative to said first edge-loading force.

18. The electrostatographic reproduction machine of claim 17, wherein each of said first shim device and said second shim device is assembled into contact with a one of said first and said second sides that is positioned downstream of said elongate second edge relative to a direction of movement of said moving surface being treated.

19. The electrostatographic reproduction machine of claim 17, wherein each of said first shim device and said second shim device as assembled has an in process direction dimension Ls that is less than a width Wb of said one-piece elongate blade member.

20. The electrostatographic reproduction machine of claim 17, wherein said different third edge-loading force is approximately equal to said different second edge-loading force.

* * * * *